US005725393A

United States Patent [19]

Steininger et al.

[11] Patent Number: 5,725,393

[45] Date of Patent: Mar. 10, 1998

[54] ELECTRICAL CONNECTOR WITH VARIABLE PLUG RETENTION MECHANISM

[75] Inventors: Jeffrey A. Steininger, Fort Wayne, Ind.; Stephen B. Leonard, Caledonia, Wis.

[73] Assignee: S. C. Johnson & Son, Inc., Racine, Wis.

[21] Appl. No.: 710,803

[22] Filed: Sep. 23, 1996

[51] Int. Cl.[6] ..... H01R 13/40

[52] U.S. Cl. ..... 439/597

[58] Field of Search ..... 439/593, 592, 439/597, 263, 264

[56] References Cited

U.S. PATENT DOCUMENTS

| | | | |
|---|---|---|---|
| 2,100,094 | 2/1937 | Wahl . | |
| 2,308,324 | 1/1943 | Benander | 439/597 |
| 2,706,803 | 12/1955 | Templeton | 339/191 |
| 4,032,877 | 6/1977 | McAlister | 337/148 |
| 4,275,374 | 6/1981 | Chaucer | 337/197 |

FOREIGN PATENT DOCUMENTS

| | | | |
|---|---|---|---|
| 693210 | 11/1930 | France | 439/592 |
| 1233555 | 5/1960 | France . | |
| 682296 | 2/1965 | Italy . | |
| 6-275332 | 9/1994 | Japan . | |
| 1410149 | 7/1988 | U.S.S.R. . | |
| 1513550 | 10/1989 | U.S.S.R. . | |

OTHER PUBLICATIONS

Switching Connector by N. K. Perkins IBM Invention Disclosure Bulletin vol. 7, No. 6 Nov. 1964 at p. 424.

*Primary Examiner*—Gary F. Paumen

[57] ABSTRACT

An electrical connector for connecting an electrical plug having prongs to circuitry has a pair of electrically conductive sockets adapted to receive the plug prongs. Each socket has an inner leg, an outer leg, and a portion which is narrower than a plug prong. An elastically deformable supporting member supports the sockets with a pair of cantilevered inner supports, which support the inner legs and define a cavity between the sockets into which the inner supports can be deflected. This allows the inner legs to deflect when the plug prongs are inserted into the sockets past the narrow portions. An intermediate member is disposed in the cavity and contacts at least one inner support at a fulcrum point at which the intermediate member opposes deflection of the inner support into the cavity, causing the corresponding inner leg to grip the plug prong with a retention force. If desired, a thermal cutoff mechanism can interrupt the electrical connection between the circuitry and one of the sockets when the intermediate member exceeds a threshold temperature, thereby disconnecting the plug.

13 Claims, 4 Drawing Sheets

ELECTRICAL CONNECTOR WITH VARIABLE PLUG RETENTION MECHANISM

BACKGROUND OF THE INTENTION

1. Field of the Invention

The present invention relates to an electrical connector, and more particularly to an electrical connector for connecting an electrical plug to circuitry, wherein varying the dimensions of an intermediate member of the connector changes a retention force with which the connector holds the plug.

2. Description of the Related Art

Electrical connectors having a conventional plug/socket construction are well known in the art. In these connectors, a plug having prongs is inserted into a socket to electrically connect a device to which the plug is attached. These connectors are used in wall-type outlets from AC power sources, with various other power supplies, as an interface between integrated circuits, as adapters for use with any of the above, and in many other applications.

Many problems can arise from loose or poor connections with conventional electrical connectors. These problems can range from a merely aggravating loss of current flow to serious property damage or bodily injury due to a fire caused by an electrical short. While these problems can be addressed by providing a tight fit between the plug prongs and the socket, attempts to do so have not always been satisfactory. Often, it has been difficult to achieve a fit with a desirable contact pressure or tightness. On one hand, the fit may be too tight, making it very difficult to plug the device into the socket and unplug the device from the socket. On the other hand, a fit that is too loose contributes to the above-mentioned problems. Even if the fit is initially correct, material fatigue may result in a gradual reduction in the correct tightness.

Several attempts have been made to provide for better and safer connections. Soviet Union Publication No. 1,410,149 to Itin, et al. discusses one such attempt, in which an electrical connector has a socket 2 containing two pairs of contacts 7. Each pair of contacts 7 has bulges 8 facing each other. Elastic insulator plates 10 are on either side of each contact pair and have holes which are aligned with the bulges of contacts 7. The connector has a cover 12 fastened to the socket 2 by screws 14. Dielectric inserts 13, made of a material less elastic than that of the insulator plates 10, are set in the holes of the insulation plates. After plug contacts 3 are inserted, contact pressure is intensified by tightening cover 12 with screws 14. This pressure is transmitted to the set of elastic insulator plates 10, which then press contacts 7 flush against plug contacts 3 over the contact area. In turn, inserts 13 press bulges 8 which are forced into the edge of holes 4 of the plug contacts 3, thus forming cold junctions. While this arrangement does provide for variable contact pressure, the insert screw mechanism is complex and better suited to the extended continuous use under vibratory conditions for which it is designed than to more general applications.

Many designs provide for contact pressure, but do not recognize the concept of varying that pressure. For instance, Japanese Laid-Open Patent Application No. 6-275332 to Sawabe describes a connector for easily replacing electronic parts. The connector has a box-like insulating body 100 and a conducting clip 200 stored in the body 100. The clip 200 is formed by folding a conducting metal flat plate into a nearly triangular shape, with both end sections curved into circular arc-shaped curve sections 220 toward the outside. A flat plate-like terminal section of an electronic part can be clipped at a clipping section 210 between both curve sections 220.

In U.S. Pat. No. 2,100,094, "Electric Cord Plug Adapter" to Wahl, a housing 17 is mounted over prongs 6 and 7. Then, auxiliary prongs 12 and 14 are inserted into openings 20 and 21 along side the prongs 6 and 7 until lugs 16 of shanks 15 drop into openings 10 and 11. The resiliency of the body 17 permits the insertion of the shanks 15 without great difficulty. Thereafter, body 17 holds the shanks 15 tightly against the prongs 6 and 7.

In U.S. Pat. No. 2,706,803, "Electrical Plug Receptacle or Socket" to Templeton, a receptacle 8 has a fixed center partition 11 of electrical insulating material forming two chambers 12. The chambers 12 each contain a plug prong receiving unit 15. Each unit 15 includes a metal strip 16 which is electrically conductive and relatively resilient. Each strip 16 is bent along a plurality of transverse lines 17 into a substantially U-shaped member 19. A block of resilient material 27, such as sponge rubber, is contained in each U-shaped member 19 between an inner ply 20 of leg 18, on one side of member 19, and plate 24, spaced from inner leg 23, on the other side of member 19. A portion of each block 27 extends through opening 28 of each plate 24. This portion bears against an inner side of a tongue 26, which depends from the top of opening 28, to urge the tongue 26 toward inner leg 23 while a surrounding portion of the block 27 bears against the inner side of the plate 24 for yieldably urging it toward the leg 23. The thickness of each plug prong 31 is greater than the normal spacing between the inner leg 23 and either the tongue 26 or the portion of the plate 24 proximal to the top of opening 28 from which the tongue projects. Each block 27 will thus be compressed to urge the plates 24 and tongues 26 individually toward the inner legs 23. Thereby, the prongs 31 will be frictionally gripped. Alternately, a spring 33 may be used in lieu of the resilient block 29. This patent does not suggest varying the construction of block 27 or spring 33 to change the retention force, which in this complex design would be complicated.

Another potential hazard with these types of devices, wholly unrelated to the quality of the connection, is the danger presented by faulty wiring. This also may result in increased temperatures, plastic deformation, or fire. Attempts have been made to address this problem by providing a thermal fuse mechanism which will cut off current flow in the event that the temperature of a particular portion of the devices rises above a certain threshold level.

For instance, U.S. Pat. No. 4,032,877, "Protector For Electric Circuits" to McAlister discloses a temperature control protector. However, the protector is not specifically designed for use with a plug. Disposed at one end of a tubular casing 12 of the protector is a ferrule-type metal terminal 14 that has a shallow circular recess 16 in its end wall, and has an opening 18 in the center of the recess 16. Another ferrule-type metal terminal 20 having opening 22 is disposed at the other end of the casing 12. A cylindrical eyelet 24 extends into casing 12 from opening 22. A stiff, elongated, homogeneous current-conducting member 30 has a left-hand end dimensioned to extend into the opening 18 of terminal 14, and has a right-hand portion dimensioned to fit into an opening 25 in the inner end of eyelet 24. Masses of heat-softenable alloy 38, 40 mechanically secure and electrically bond the ends of the current-conducting member 30 to the terminal 14 and the eyelet 24, respectively. If the temperature of the protector 10 rises above the softening temperature of the masses 38, 40, the helical compression spring moves the current conducting member 30 to open the circuit, and moves the head 32 thereof to a position indicating an open circuit.

Similarly, U.S. Pat. No. 4,275,374, "FusePlug Adapter For Electrical Cord" to Chaucer, discusses a plug that includes a removable electrical fuse (not disclosed as being thermally triggered), in which a male element 1 extends from bottom opening 11*a*" toward a female element which is mounted in a first channel adjacent upper opening 11*a*'. Likewise, a male element 2 extends from opening 11*b*" of a second channel, and a female element corresponding, but not continuous, thereto is located adjacent upper opening 11*b*'. The male element 2 and its corresponding female element each have a flange extending into the third channel. The male and female flanges contact, respectively, a lower fuse contact 12*a* and an upper fuse contact 12*b* of an electrical fuse 12. The fuse 12 is insertable and removable from the third channel through an insertion hole 6 at the bottom end face of the housing structure.

Various other electrical connectors have been proposed, but they likewise do not address any of the foregoing concerns. For example, IBM Invention Disclosure Bulletin, vol. 7, no. 6, at page 424, to Perkins discusses a switching connector. In that connector, terminal block 1 has a spring contact 2 that normally engages contact 3 for establishing continuity between circuit input lead 4 and circuit output lead 5. Insertion of plug 6 results in circuit switching. Knife blade 7 has a metallic portion 8 and a plastic portion 9. Metallic portion 8 connects input lead 4 through contact 2 to output lead 10. Plastic portion 9 insulates contact 3 from the circuit to disconnect output lead 5 from contact 2.

Soviet Union Publication No. 1,513,550 discusses a connector for electro-heating devices. The connector includes an insert 1 with seats 2 for positioning contacts 3 connected to cable 5. The contacts 3 are set via holes 6 on cylindrical shoulders 7 of plug 8, which has the shape of a parallelepiped positioned in a slot 10 of the tail part of insert 1 for insulating seats 2.

None of the foregoing devices addresses the difficulty in "fine-tuning" the design of the devices so that the retention force remains within an acceptable range. Also, they do not provide a mechanism which can be simply and inexpensively altered to compensate for different operating conditions, the use of different materials or the need for a different retention force. In addition, none provide both a retention mechanism and the desired additional element of a thermal cutoff.

Accordingly, there is a need in the art for an electrical connector that provides a mechanism for varying the retention force of a plug.

There is also a need in the art for an electrical connector that includes an intermediate member, varying the dimensions of which changes a retention force with which the connector holds the plug.

There is an additional need for such a connector that provides a simple and inexpensive means for providing variable retention forces.

There is yet another need in the art for such a connector that provides a thermal cutoff which will interrupt the flow of current in the event of overly high temperatures, for example.

SUMMARY OF THE INVENTION

An object of the invention is to address the foregoing needs in the art and to provide an electrical connector having a variable mechanism for providing a desired plug retention force.

An additional object of the invention is to provide such a connector for which the retention force can be simply and inexpensively altered.

A further object of the invention is to provide such a connector having a thermal cutoff mechanism for interrupting the flow of current should the temperature of the connector rise above a certain threshold.

According to one aspect, the present invention provides an electrical connector for connecting an electrical plug having prongs to circuitry. The connector has a pair of electrically conductive sockets adapted to receive the plug prongs. Each socket has an inner leg and an outer leg, defining a narrow portion which is narrower than one of the plug prongs. An elastically deformable supporting member supports the sockets. The supporting member has a pair of cantilevered inner supports supporting the inner legs and defining a cavity between the sockets into which the inner supports can be elastically deflected to allow the inner legs to deflect when the plug prongs are inserted into the sockets past the narrow portions. An intermediate member is disposed in the cavity and contacts each of the inner supports at a fulcrum point at which the intermediate member opposes deflection of the inner supports into the cavity, causing the inner legs to grip the plug prongs with a retention force when the plug prongs are inserted into the sockets past the narrow portions.

The intermediate member can include a conductive element which completes an electrical connection between the circuitry and a first of the sockets. The intermediate member can further include a thermal cutoff mechanism which interrupts the electrical connection between the circuitry and the first of the sockets when the intermediate member exceeds a threshold temperature, thereby electrically disconnecting the plug from the circuitry. The intermediate member can be in thermal communication with at least one of the sockets.

Each of the inner supports can have a base and a tip between which the fulcrum point is positioned. The intermediate member can further have a thermally conductive sheath which encases the thermal cutoff mechanism and the conductive element and contacts each of the inner supports at its fulcrum point. Conduit means can be provided for thermal communication between the intermediate member and the plug. Further, the dimensions of the sheath of the intermediate member can be varied, to change the position of the fulcrum points between the bases and the tips, to vary the retention force.

According to another aspect of the present invention, an electrical connector is provided for connecting an electrical plug having two prongs to circuitry. The connector has an electrically conductive first socket to receive a first of the plug prongs. The first socket has a first inner leg and a first outer leg, at least one of which is convex relative to the other to define a narrow portion of the first socket which is narrower than the first plug prong. An electrically conductive second socket is adapted to receive a second of the plug prongs and has a second inner leg and a second outer leg, at least one which is convex relative to the other, to define a narrow portion of the second socket which is narrower than the second plug prong.

An elastically deformable first supporting portion supports the first socket such that the first inner leg can be deflected away from the first outer leg to allow the first plug prong to be inserted into the first socket. An elastically deformable second supporting portion, spaced from the first supporting portion, supports the second socket such that the second inner leg can be deflected away from the second outer leg to allow the second plug prong to be inserted into the second socket.

An intermediate member is disposed between the supporting portions and contacts each of the supporting portions at a respective fulcrum point at which the intermediate member resists deflection of the supporting portions toward one another, causing the inner legs to grip the plug prongs with a retention force when the plug prongs are inserted into the sockets.

The intermediate member can have a thermal cutoff mechanism for interrupting electric current through the first socket when the intermediate member exceeds a threshold temperature. The fulcrum points of the supporting portions can be proximal to a position on the first inner leg and a position on the second inner leg, respectively.

According to yet another aspect, the present invention provides an electrical connector for connecting an electrical plug having prongs to circuitry. The connector has a pair of electrically conductive sockets adapted to receive the plug prongs. Each socket has an inner leg and an outer leg, defining a narrow portion which is narrower than one of the plug prongs. An elastically deformable supporting member supports the sockets. The supporting member has a pair of cantilevered inner supports supporting the inner legs and defining a cavity between the sockets into which the inner supports can be elastically deflected to allow the inner legs to deflect when the plug prongs are inserted into the sockets past the narrow portions. An intermediate member is disposed in the cavity and contacts at least one of the inner supports at a respective fulcrum point at which the intermediate member opposes deflection of the at least one inner support into the cavity, causing a corresponding inner leg to grip one of the plug prongs with a retention force when the plug prongs are inserted into the sockets past the narrow portions.

This brief summary of the invention has been provided so that the nature of the invention may be generally understood. However, this summary should not be construed to limit the invention.

The foregoing and other objects, aspects, features, and advantages of the present invention will become apparent from the following detailed description of the preferred embodiments in conjunction with the accompanying drawings.

BRIEF DESCRIPTION OF THE DRAWINGS

Like reference numerals have been used for like or corresponding elements throughout the views.

DETAILED DESCRIPTION OF THE PREFERRED EMBODIMENTS

Figure 1A:
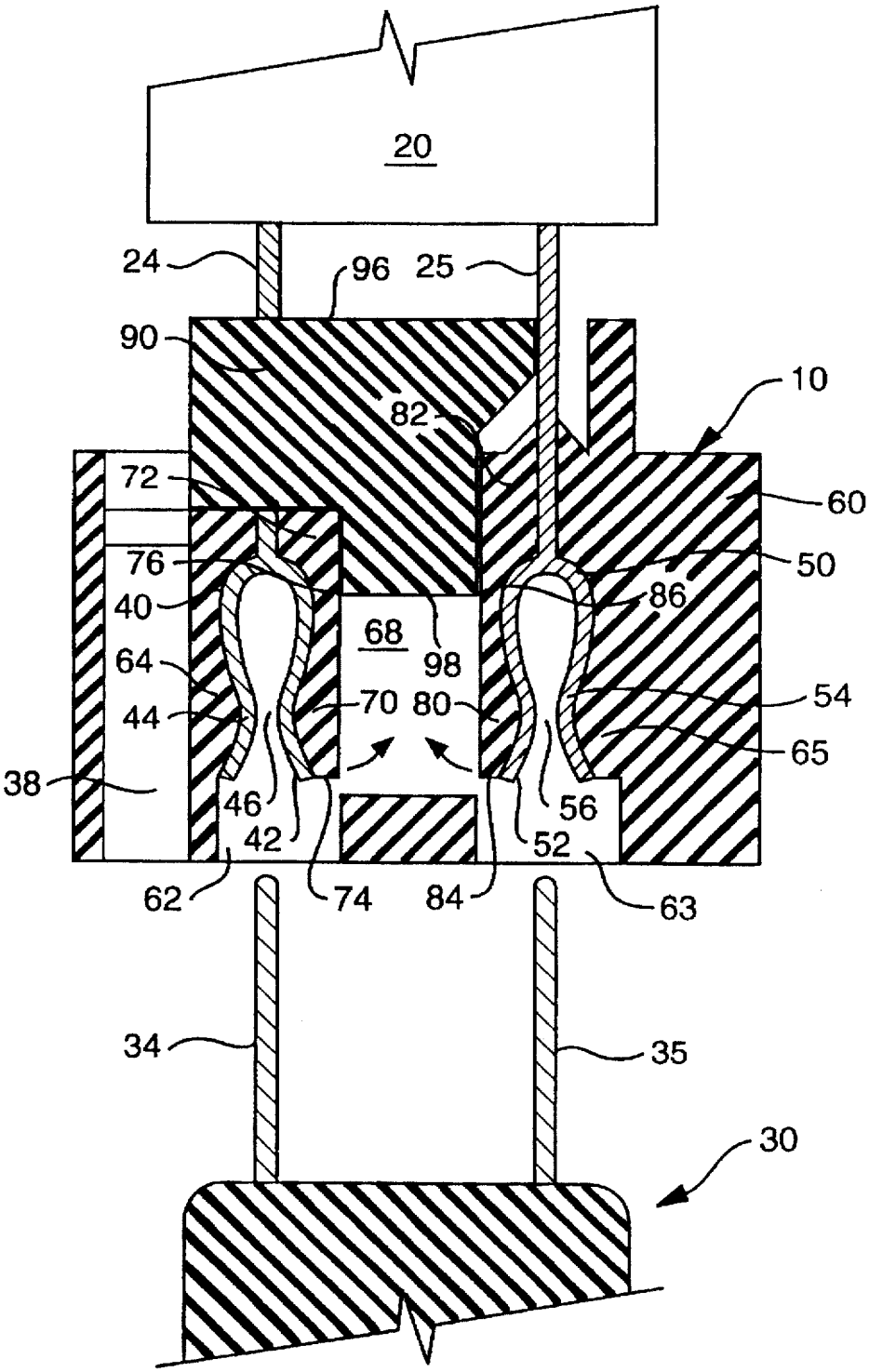
FIG. 1A is a partial cross-sectional view of an electrical connector in a first aspect of a preferred embodiment of the present invention.
Figure 1B:
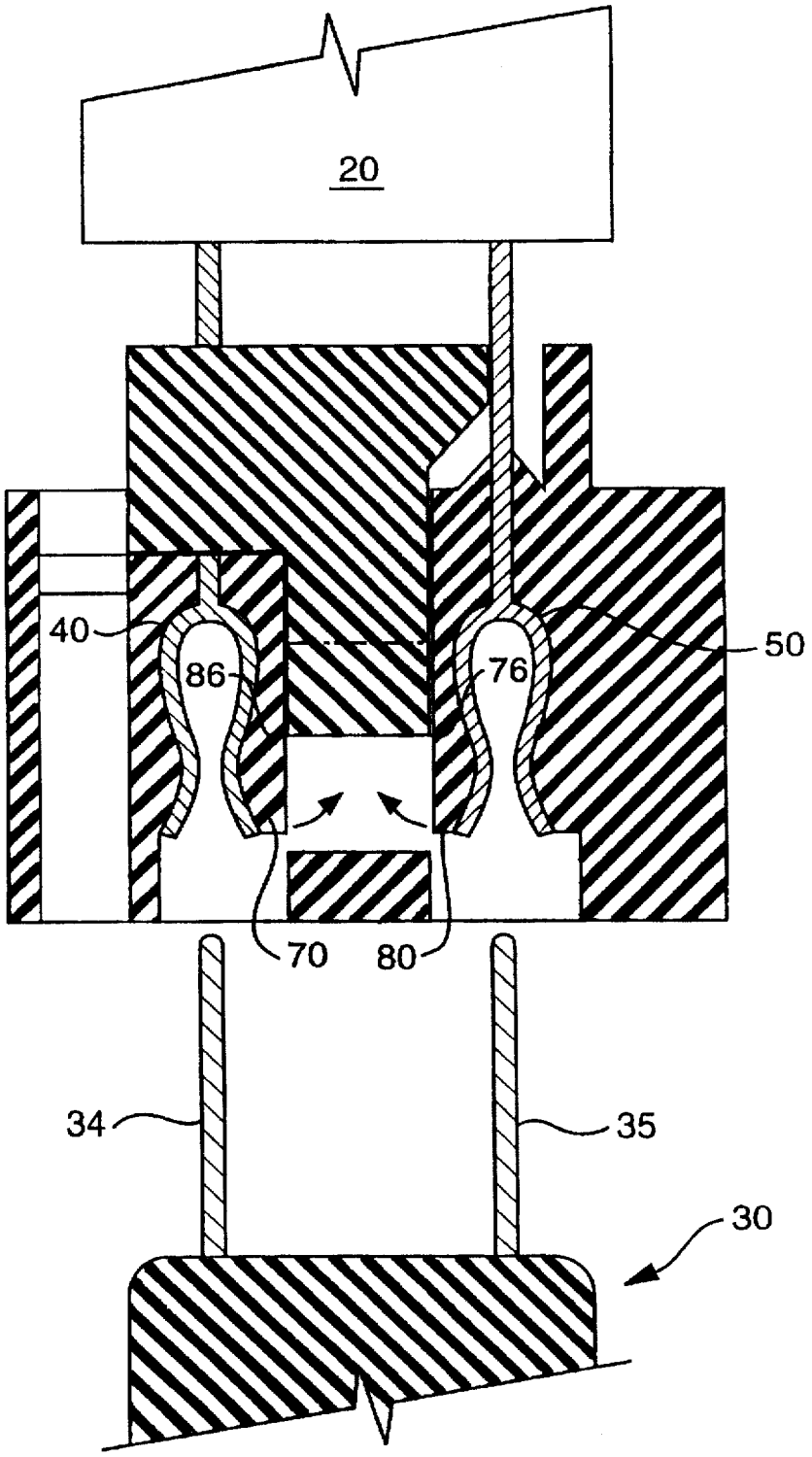
FIG. 1B is a partial cross-sectional view of an electrical connector in a second aspect of a preferred embodiment of the present invention.

FIGS. 1A and 1B show partial cross-sectional views of first and second aspects of a preferred embodiment of the electrical connector 10 of the present invention, which includes electrically conductive sockets 40, 50, which are adapted to receive prongs 34, 35 of plug 30. Supporting member 60 encases the sockets 40, 50, leaving openings 62, 63 for insertion of the prongs 34, 35. Leads 24, 25 connect sockets 40, 50 to circuitry 20. Circuitry 20 schematically represents any of a number of circuits or circuit elements. For example, circuitry 20 can be a power source (for a wall socket or otherwise), an integrated circuit, or even simple adapter prongs for insertion into a wall socket or the like.

In this embodiment, intermediate member 90 is interposed between lead 24 and socket 40. Therefore, a conductive element, such as a wire (obscured by intermediate member 90 in this view), is disposed through intermediate member 90 to complete the electrical connection. A more detailed discussion of a preferred embodiment of this electrical connection appears later in this disclosure with reference to FIGS. 3A and 3B.

Sockets 40, 50 are formed with inner legs 42, 52 and outer legs 44, 54, respectively, which are each shown as being arcuate in shape. It is not necessary that any or all of the legs 42, 44, 52, 54 be arcuate in this manner. What is important is that at least portions 46, 56 of the sockets 40, 50 be narrower than the prongs 34, 35 of the plug 30, so that the prongs 34, 35 fit snugly into sockets 40, 50.

Supporting portions 64, 65 of supporting member 60 support the sockets 40, 50, respectively. Supporting portions 64, 65 preferably support the outer legs 44, 54 rigidly. However, inner supports 70, 80 of the supporting portions 64, 65 are cantilevered and flexibly support the inner legs 42, 52. Supporting member 60 is formed of an elastically deformable and electrically insulative material, preferably a plastic such as polypropylene, or an equivalent such as high density polyethylene polymer, or polyvinylchloride. Therefore, inner supports 70, 80 can elastically deflect, in the directions indicated by the arrows, into cavity 68 to permit the inner legs 42, 52 to likewise deflect. This deformation allows the plug prongs 34, 35 to fit into the sockets 40, 50 past the narrow portions 46, 56. The material properties of the inner supports 70, 80 and the inner legs 42, 52 will affect the overall resistance to deformation and therefore contribute to the snugness of the fit.

Intermediate member 90 extends partially into cavity 68 and abuts against both of the inner supports 70, 80. The end 98 of the intermediate member 90 abuts the inner supports 70, 80 at fulcrum points 76, 86 disposed between the bases 72, 82 and the tips 74, 84 of the inner supports 70, 80. An outer sheath 96 of intermediate member 90 is formed of a rigid—preferably more rigid than the material composing the supporting member 60, and electrically insulative material, such as polyproplene, RYTON® or an equivalent material, such as acrylonitrile butadiene sytrene polymer, polystyrene or high density polyethylene.

Beyond the fulcrum points 76, 86, the inner supports 70, 80 can freely deform. However, at the fulcrum points 76, 86, and toward the bases 72, 82, the intermediate member 90 obstructs the inward elastic deflection of the inner supports 70, 80. The location of the fulcrum points 76, 86—i.e., the distance by which the intermediate member 90 extends toward the tips 74, 84 of the inner supports 70, 80—will dictate to what degree the inner supports 70, 80 are permitted to flex. A longer intermediate member 90—and therefore a shorter distance between the fulcrum points 76, 86 and the tips 74, 84—creates a shorter "lever arm" and results in a greater effective impedance to the inward deformation of the inner supports 70, 80. Conversely, a longer distance between the fulcrum points 76, 86 and the tips 74, 84 allows the inner supports 70, 80 to more easily flex. Therefore, varying the dimensions of the intermediate member 90 dramatically alters the force with which the sockets 40, 50 will "grip" the prongs 34, 35.

In an alternative embodiment, it is within the concepts of the present invention that the intermediate member 90 can engage and resist deflection of only one of the inner supports 70, 80. In order to accomplish this, the intermediate member 90 would need to be sufficiently stiff to provide the requisite resistance to deflection of that inner support 70 or 80. It would also be preferable to anchor the intermediate member 90 by any suitable means to resist the torque that would be incurred in opposing only one of the inner supports 70, 80.

Figure 2:
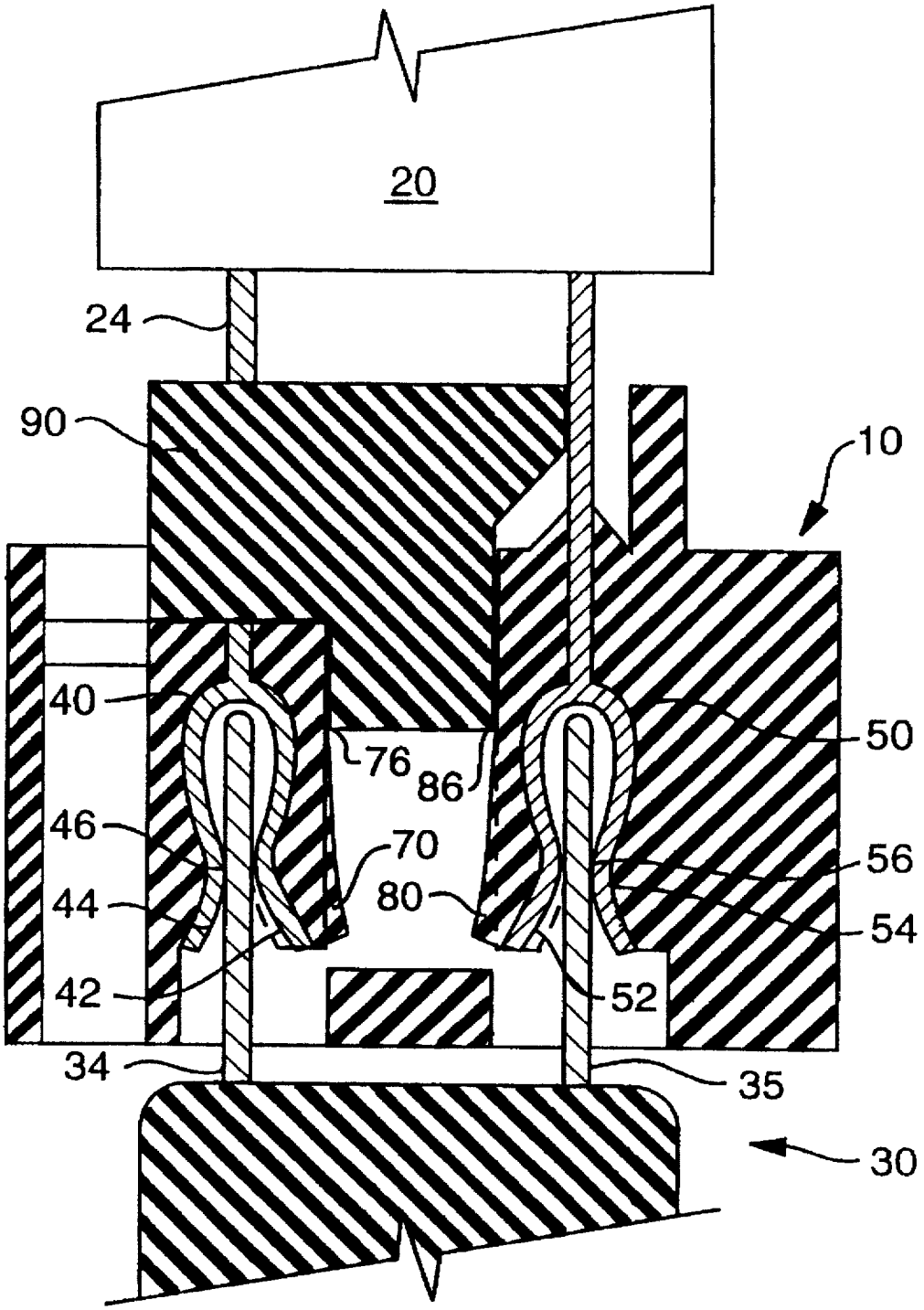
FIG. 2 is a partial cross-sectional view of the connector shown in FIG. 1A with the plug element inserted.

FIG. 2 shows the embodiment of FIG. 1A with the plug 30 inserted into the connector 10. The prongs 34, 35 contact the outer legs 44, 54 and the inner legs 42, 52 of the sockets 40, 50 at the narrow portions 46, 56. The rigidly supported outer legs 44, 54 have substantially retained their shape and positions. The inner legs 42, 52 have deflected inwardly to permit the insertion of the prongs 34, 35. To accommodate this deflection, the inner supports 70, 80, beyond the fulcrum points 76, 86, have flexed as shown.

In this embodiment, intermediate member 90 is disposed between socket 40 and lead 24. Therefore a conductive element should be provided therethrough to complete the electrical connection between socket 40 and lead 24. This may be done by simply providing a wire contact through intermediate member 90.

In a preferred embodiment, however, the conductive element is provided in conjunction with a thermal cutoff mechanism which interrupts this connection when a threshold temperature is exceeded. Thermal cutoff mechanisms are available in a variety of configurations, and the particular configuration utilized is not essential to the present invention. For example, a protector configured similarly to that show in the McAlister '877 patent, discussed earlier, could be employed. Thermal cutoffs commercially available under the trademark MICROTEMP® from Therm-O-Disc, Inc., Mansfield, Ohio, have proven to be well suited for this application. The details of the conductive element and thermal cutoff having this general configuration will now be discussed with reference to FIGS. 3A and 3B.

Figure 3B:
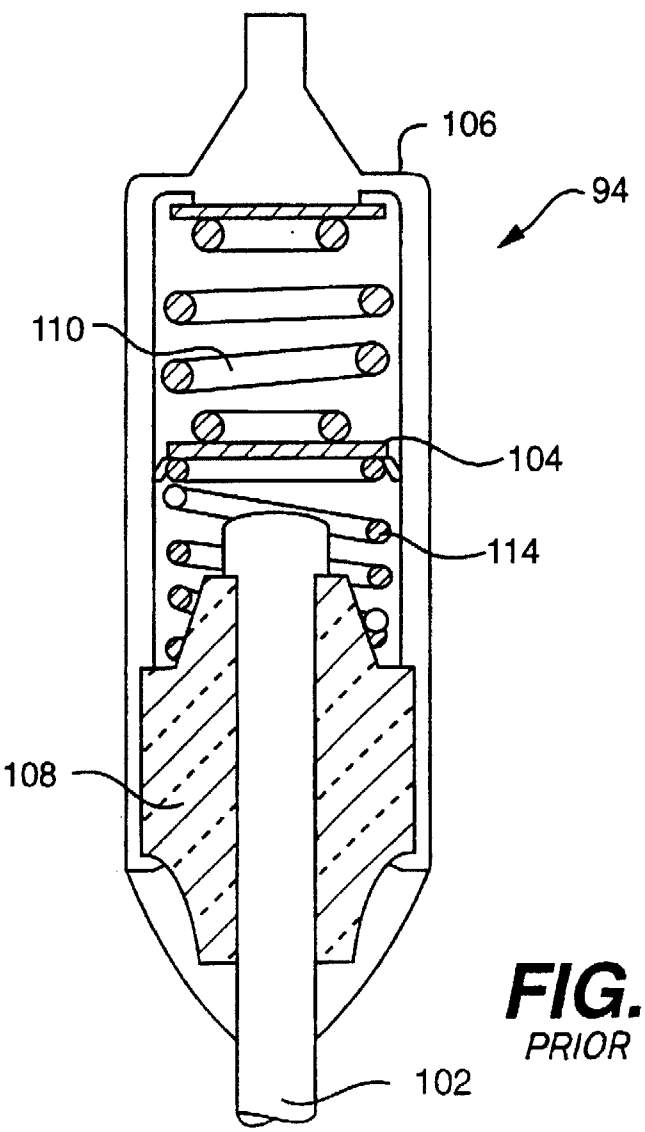
FIG. 3B PRIOR ART
FIG. 3B is a partial cross-sectional view of the thermal cutoff element shown in FIG. 3A, in the open position.
Figure 3A:
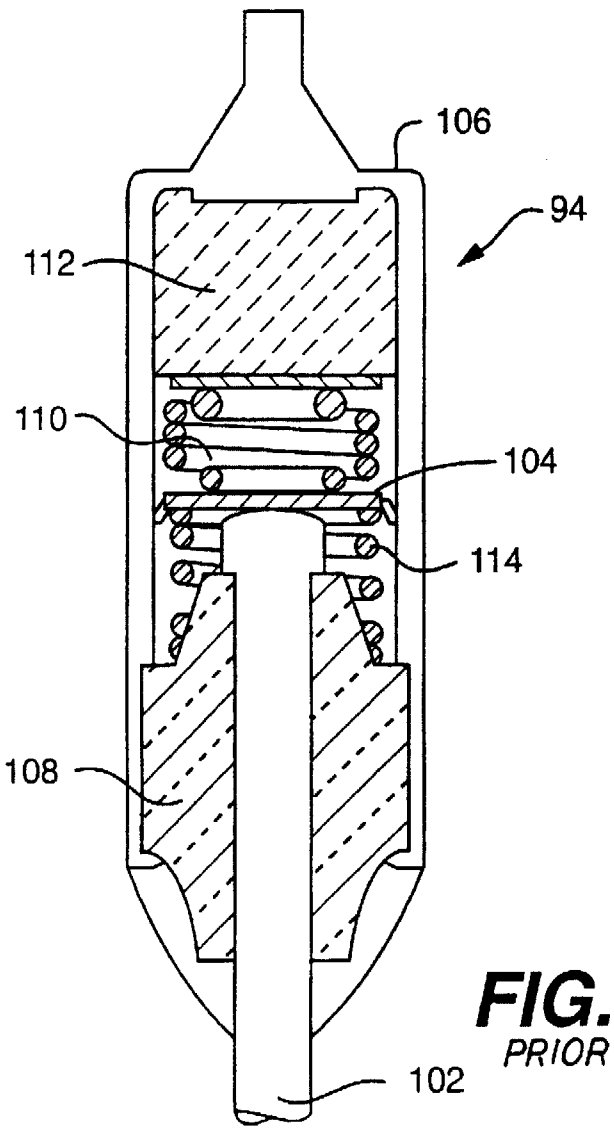
FIG. 3A PRIOR ART
FIG. 3A is a partial cross-sectional view of a thermal cutoff element, in the closed position, for use in the preferred embodiments of the present invention.

FIG. 3A shows the thermal cutoff mechanism 94, which, in the embodiment of FIG. 2, is disposed within intermediate member 90. The relative disposition of mechanism 94 within intermediate member 90 is not vital to the invention, as long as the socket 40 is connected thereby to lead 24. The mechanism 94 includes a multi-staged conductive element made up of pin contact 102, movable contact 104, and lead assembly 106. Pin contact 102 is held in place and out of contact with lead assembly 106 by bushing 108. Movable contact 104 is slidably disposed in contact with lead assembly 106, and is urged against pin contact 102 by compression spring 110, which is disposed between movable contact 104 and thermal seat 112. Current passes between pin contact 102 and lead assembly 106 via movable contact 104.

The thermal seat 112 is made up of an electrically non-conductive material which melts at a threshold temperature. This threshold temperature can be set or varied, as desired. Typical threshold temperatures are on the order of 72° C. to 215° C. If the thermal cutoff mechanism 94 exceeds this threshold temperature, the seat 112 will melt, allowing the compression spring 110 to expand as shown in FIG. 3B. When compression spring 110 expands, the force with which it urges movable contact 104 against pin contact 102 decreases. This reduction in urging force allows trigger spring 114 to expand and force the movable contact 104 away from pin contact 102, as shown in FIG. 3B. Thus, the conductive element 92 is opened, disrupting the flow of current through thermal cutoff mechanism 94.

For a more detailed discussion of the MICROTEMP® thermal cutoffs, the disclosures of Therm-O-Disc, Inc.'s *Technical Bulletin TCO-A* and Michael McQuade's article entitled "Proper Selection and Installation of Thermal Cutoff Devices" in *Electrical Manufacturing (September,* 1988), pages 29–31, are incorporated herein by reference.

As discussed earlier, the sheath 96 which encases intermediate member 90 should be relatively rigid and electrically non-conductive. In the above-described embodiment with the thermal cutoff mechanism 94, the sheath 96 should also be thermally conductive. While any of a number of materials fit these specifications, a compound commercially marketed by Phillips Petroleum Company under the trademark RYTON® has proven to be particularly well suited for this use because of its thermal conductivity and hardness. Of course, other materials, which perform equivalent functions also could be used, such as polyproplene, polyphenolsulfide, or polyvinylchloride.

Returning to FIGS. 1A and 1B, the sheath 96 of the intermediate member 90 can be formed into any desirable shape. By increasing or decreasing the length to which the end 98 of the intermediate member 90 extends into cavity 68, the force with which the sockets 40, 50 "grip" the prongs 34, 35 can be varied proportionately. Further, in this embodiment, with sheath 96 disposed in cavity 68, if sockets 40, 50 get hot, heat will transmit to intermediate member 90. If the temperature gets too high, thermal cutoff mechanism 94 will open, shutting off the flow of current. For the same reason, sheath 96 contacts lead 25. Further, a conduit 38 can be provided so that heat can be transmitted directly from the plug 30 to the intermediate member 90. In this manner, the thermal cutoff 94 can be triggered by an inappropriate increase in the temperature of any of the components.

The selection of materials for the supporting member 60, the sheath 96, and the sockets 40, 50 will influence the retention force to some degree. However, simply changing the degree to which the end 98 of the intermediate member 90 extends toward the tips 74, 84 of the inner supports 70, 80—i.e., varying the position of the fulcrum points 76, 86—causes more profound variations. In addition to facilitating the variance of the retention force, this arrangement relies less on material elasticity and more on mechanical interaction, which minimizes the likelihood that the retention force will decrease over repeated usage due to material fatigue.

INDUSTRIAL APPLICABILITY

The electrical connector of the present invention can be used wherever it is desirable to provide an electrical connection in which the socket element retains the plug element by a gripping force. It is particularly well suited for use in wall sockets or other applications for which industrial standards dictate the force with which the socket element must retain the plug element. For example, Underwriters Laboratories (UL) sets forth a range of acceptable forces required to plug and unplug a power cord into a wall outlet. These acceptable forces are available from UL in publication number 498. The electrical connector of the present invention readily achieves these desired tolerances.

By configuring the outlet in the manner disclosed and claimed herein, compensation for specific materials, differing operating conditions, and varying specifications can be made by simply changing the length of the intermediate member. The sheath 96 of intermediate member 90 can be mass-produced in various sizes corresponding to different applications. A full spectrum of adjustments can be made available by merely removing and replacing the intermediate member 90.

In the alterative, the sheath 96 of the intermediate member 90 can be mass-produced with "snap-off" stages. For example, the sheath 96 could be produced having the dimensions shown in FIG. 1B, but provided with a frangible region at the broken line. By breaking off the sheath 96 at this frangible portion, the remaining sheath 96 would have the dimensions shown in FIG. 1A. The sheath 96 could be provided with multiple frangible regions to create an intermediate member 90 that would be adaptable to several applications.

In addition, the inclusion of the thermal cutoff mechanism makes the present invention useful wherever temperature control or fire hazard prevention is desired.

Although specific embodiments of the present invention have been described in detail, it will be understood that this description is merely for purposes of illustration. Various modifications of and equivalent structures corresponding to the disclosed aspects of the preferred embodiments in addition to those described above may be made by those skilled in the art without departing from the spirit of the following claims. For example, the intermediate member 90 may take on various shapes and sizes, and may be formed without a thermal cutoff mechanism. Further, if the intermediate member 90 is not disposed between a socket 40, 50 and its lead line 24, 25, no conductive element is needed therethrough. Additionally, those of ordinary skill in the art will appreciate that certain variations in the size, shape, number, arrangement, and material of various portions of the disclosed connector may be made without departing from the spirit of the invention. Accordingly, the scope of the invention defined by the following claims should be accorded the broadest reasonable interpretation so as to encompass such modifications and equivalent structures.

What is claimed is:

1. An electrical connector for connecting an electrical plug having prongs to circuitry, said connector comprising:

a pair of electrically conductive sockets adapted to receive the plug prongs, each socket having an inner leg and an outer leg defining a narrow portion which is narrower than a respective plug prong;

an elastically deformable supporting member supporting said sockets, said supporting member having a pair of cantilevered inner supports supporting said inner legs and defining a cavity between said sockets into which said inner supports can be elastically deflected to allow said inner legs to deflect when the plug prongs are inserted into said sockets past said narrow portions; and an intermediate member disposed in the cavity and contacting each of said inner supports at a fulcrum point at which said intermediate member opposes deflection of said inner supports into the cavity, causing said inner legs to grip the plug prongs with a retention force when the plug prongs are inserted into said sockets past said narrow portions.

2. The connector of claim 1, wherein each of said inner supports has a base and a tip between which the fulcrum point is positioned.

3. The connector of claim 2, wherein a dimension of said intermediate member may be varied, to change the position of the fulcrum point between a respective base and tip, which varies the retention force.

4. The connector of claim 1, wherein said intermediate member comprises a conductive element which completes an electrical connection between the circuitry and a first of said sockets.

5. The connector of claim 4, wherein said intermediate member further comprises a thermal cutoff mechanism which interrupts the electrical connection between the circuitry and said first of said sockets when said intermediate member exceeds a threshold temperature, thereby electrically disconnecting the plug from the circuitry.

6. The connector of claim 5, wherein said intermediate member is in thermal communication with at least one of said sockets.

7. The connector of claim 6, wherein (i) each of said inner supports has a base and a tip between which the fulcrum point is positioned, and (ii) said intermediate member further comprises a thermally conductive sheath which encases said thermal cutoff mechanism and said conductive element and contacts each of said inner supports at the fulcrum point.

8. The connector of claim 7, wherein a dimension of said sheath of said intermediate member may be varied, to change the position of the fulcrum point between a respective base and tip, which varies the retention force.

9. The connector of claim 8, further comprising a conduit for thermal communication between said intermediate member and the plug.

10. An electrical connector for connecting an electrical plug having prongs to circuitry, said connector comprising:

a pair of electrically conductive sockets adapted to receive the plug prongs, each socket having an inner leg and an outer leg defining a narrow portion which is narrower than one plug prong;

an elastically deformable supporting member supporting said sockets, said supporting member having a pair of cantilevered inner supports supporting said inner legs and defining a cavity between said sockets into which said inner supports can be elastically deflected to allow said inner legs to deflect when the plug prongs are inserted into said sockets past said narrow portions; and an intermediate member disposed in the cavity and contacting at least one of said inner supports at a respective fulcrum point at which said intermediate member opposes deflection of said at least one inner support into the cavity, causing a corresponding inner leg to grip one of the plug prongs with a retention force when the plug prongs are inserted into said sockets past said narrow portions.

11. The connector of claim 10, wherein said intermediate member comprises:

a conductive element which completes an electrical connection between the circuitry and a first of said sockets; and a thermal cutoff mechanism which interrupts the electrical connection between the circuitry and said first of said sockets when said intermediate member exceeds a threshold temperature, thereby electrically disconnecting the plug from the circuitry.

12. The connector of claim 11, wherein (i) said at least one inner support has a base and a tip between which the fulcrum point is positioned, and (ii) said intermediate member further comprises a thermally conductive sheath which encases said thermal cutoff mechanism and said conductive element and contacts said at least one inner support at the fulcrum point.

13. The connector of claim 12, wherein a dimension of said sheath of said intermediate member may be varied, to change the position of the fulcrum point between the base and tip of said at least one inner support, which varies the retention force.

* * * * *